US011635088B1

(12) United States Patent
Ma et al.

(10) Patent No.: US 11,635,088 B1
(45) Date of Patent: Apr. 25, 2023

(54) COOLING FAN

(71) Applicant: CHAMP TECH OPTICAL (FOSHAN) CORPORATION, Foshan (CN)

(72) Inventors: Xiao-Guang Ma, Foshan (CN); Zheng Luo, Foshan (CN); Yung-Ping Lin, New Taipei (TW); Yong-Kang Zhang, Shenzhen (CN)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 0 days.

(21) Appl. No.: 17/825,081

(22) Filed: May 26, 2022

(30) Foreign Application Priority Data

Dec. 28, 2021 (CN) ..... 202111623096.3

(51) Int. Cl.
*F04D 29/38* (2006.01)
*F04D 29/34* (2006.01)

(52) U.S. Cl.
CPC ..... *F04D 29/34* (2013.01); *F04D 29/384* (2013.01); *F05D 2260/961* (2013.01)

(58) Field of Classification Search
CPC ..... F04D 29/384; F05D 2260/961
See application file for complete search history.

(56) References Cited

U.S. PATENT DOCUMENTS 3,058,528 A * 10/1962 Hiersch ..... F01P 5/02 415/119
8,508,093 B2 * 8/2013 Wu ..... F04D 25/0646 310/156.45
11,333,168 B2 * 5/2022 Iwata ..... F04D 29/386
2012/0321457 A1 * 12/2012 Yan ..... F04D 25/0613 415/220

* cited by examiner

*Primary Examiner* — Sabbir Hasan
(74) *Attorney, Agent, or Firm* — ScienBiziP, P.C.

(57) ABSTRACT

A cooling fan creating a more stable airflow for heat-removing purposes, with reduced noise of operation, comprises a rotor hub and preferably an odd number of blades mounted on periphery of the rotor hub in unequal intervals. Adjacent blades are configured with different shapes, reducing the noise generated during operation without affecting the cooling effect.

10 Claims, 6 Drawing Sheets

COOLING FAN

CROSS-REFERENCE TO RELATED APPLICATIONS

This application claims priority to China Application No. 202111623096.3, having a filing date of Dec. 28, 2021, filed in China State Intellectual Property Administration, the entire contents of which is hereby incorporated by reference.

FIELD

The subject matter relates to heat dissipation technologies of electronic equipment, and more particularly, to a cooling fan.

BACKGROUND

Generally, electronic equipment is equipped with radiators for heat dissipation, and cooling fans to assist in removing the heat. However, cooling fans are arranged with blades in equal intervals, noises produced by such arrangements are loud because the fan blades evenly spaced on the rotor hub will impel the air periodically and when the impelling is superimposed, thereby amplifies the noise. The noise can be reduced by arranging fan blades in unequal intervals; however, such arrangements would affect the working efficiency of the cooling fan.

SUMMARY

An objective of the present disclosure is achieved by providing a cooling fan comprising:

a rotor hub;

a plurality of blades mounted on periphery of the rotor hub in unequal intervals, wherein each blade comprises a first surface and a second surface opposite to the first surface, the first surface comprises a first side, a second side, a third side, and a fourth side, wherein the blade is connected to the rotor hub at the third side and the fourth side is opposite to the third side and away from the rotor hub, the first side and the second side extend from the rotor hub and are connected between the third side and the fourth side;

each blade is provided with a first projection plane parallel to a tangential plane of the rotor hub, the first projection plane intersects with the first surface at a first line and intersects with the second surface at a second line, the first line and the second line are connected by a first point on the first side and a second point on the second side, the blade thus having a profile on the first projection plane formed by the first line, the second line, the first point, and the second point;

the first surface of each blade is an irregular convex surface with a vertex and the second surface of each blade is an irregular concave surface with a depression point, the vertex is projected on the first projection plane to form a third point and the depression point is projected on the first projection plane to form a fourth point, an angle between a third line connecting the first point and the third point, and a fourth line connecting the second point and the fourth point is defined as a first angle, the first angles of each two adjacent blades are different.

In further embodiments, the second side of each blade is connected to the rotor at a second intersection;

the rotor hub comprises a base, and a second projection plane is provided parallel to the base, a center point of the base is projected on the second projection plane to form a reference point, the second intersection of each blade is projected on the second projection plane to form a fifth point, a fifth line is formed by connecting the fifth point with the reference point; the angle between the fifth line of adjacent blades is defined as a second angle, the second angle of each two adjacent blades are different.

In further embodiments, the difference in angle between the first angle of each two adjacent blades ranges from 1° to 4°.

In further embodiments, the angle difference between the second angle of each two adjacent blades ranges from 2° to 15°.

In further embodiments, the angle between the fourth line of each blade and the base is defined as a fourth angle, the angle difference between the fourth angle of each two adjacent blades ranges from 0° to 3°.

In further embodiments, the distance from the first point of each blade to the base is defined as height, and difference in height of each two adjacent blades ranges from 0 mm to 3 mm.

In further embodiments, the first side of each blade is connected to the rotor at a first intersection;

the first intersection is projected on the second projection plane to form an eighth point, an eighth line is formed by connecting the eighth point with the reference point, a ninth line is formed by projecting the first line of respective blade on the second projection plane, an angle between the eighth line and the ninth line is defined as a fifth angle, the angle difference between the fifth angles of each two adjacent blades ranges from 0.5° to 5°.

In further embodiments, there is a filleted corner at the connection of the first side and the fourth side of each blade and at the connection of the second side and the fourth side of each blade.

In further embodiments, the cooling fan is provided with 3-8 blades.

In further embodiments, the rotor hub and the blades thereon are integrally formed.

In operation, the cooling fan is actuated by external driving devices, the plurality of blades rotate with the rotor hub to generate airflow by impelling air, as the blades are uneven spaced on the rotor hub, the air will not be impelled periodically; as each two adjacent blades have different inlet and outlet angles due to their different configurations, the airflow velocity and stability of the flow field of the cooling fan are improved. Therefore noise generated during operation of the cooling fan is reduced without diminishing the cooling effect.

BRIEF DESCRIPTION OF THE DRAWINGS

Implementations of the present technology will now be described, by way of example only, with reference to the attached figures.

DETAILED DESCRIPTION

Figure 1:
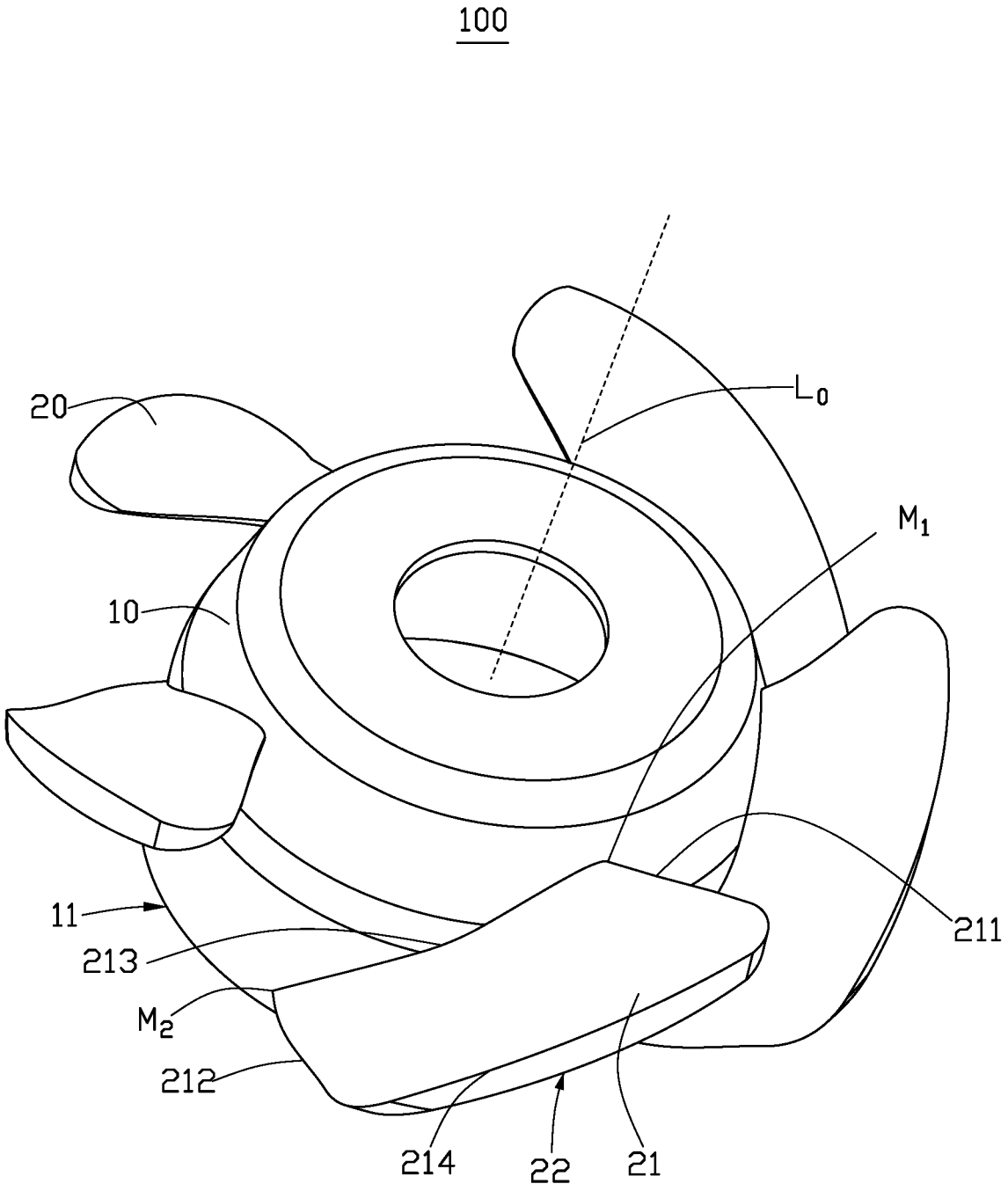
FIG. 1 is a perspective view of an embodiment of a cooling fan according to the present disclosure.

It will be appreciated that for simplicity and clarity of illustration, where appropriate, reference numerals have been repeated among the different figures to indicate corresponding or analogous components. The description is not to be considered as limiting the scope of the embodiments described herein. The drawings are not necessarily to scale and the proportions of certain parts may be exaggerated to better illustrate details and features of the present disclosure.

It should be understood that, the terms "first" and "second" are used to distinguish between elements and are not used to denote a particular order or imply a number of technical features, therefore, unless specifically defined otherwise, features described with "first" and "second" may expressly or implicitly include one or more of the stated features. In the description of the present application, "plurality" means two or more, unless otherwise expressly and specifically defined.

In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described.

The term "comprising," when utilized, means "including, but not necessarily limited to"; it specifically indicates open-ended inclusion or membership in the so-described combination, group, series, and the like.

An aspect of the present disclosure provides a cooling fan comprising a rotor hub and a plurality of blades mounted on periphery of the rotor hub in unequal intervals, wherein each blade comprises a first surface and a second surface opposite to the first surface. The first surface comprises a first side, a second side, a third side, and a fourth side, wherein the blade is connected to the rotor hub at the third side, the fourth side is opposite to the third side and away from the rotor hub. The first side and the second side extend from the rotor hub and are connected between the third side and the fourth side;

Each blade is provided with a first projection plane parallel to a tangential plane of the rotor hub, the first projection plane intersects with the first surface at a first line and intersects with the second surface at a second line. The first line and the second line are connected by a first point on the first side and a second point on the second side, the blade thus having a profile on the first projection plane formed by the first line, the second line, the first point, and the second point;

the first surface of each blade is an irregular convex surface with a vertex and the second surface of each blade is an irregular concave surface with a depression point, the vertex is projected on the first projection plane to form a third point and the depression point is projected on the first projection plane to form a fourth point, an angle between a third line connecting the first point and the third point and a fourth line connecting the second point and the fourth point is defined as a first angle, the first angles of adjacent blades are different.

The cooling fan according to the application is configured with unevenly spaced blades on the rotor, which avoids periodic impelling of the air, adjacent blades have different inlet and outlet angles due to their different configurations, which improves the airflow velocity and stability of the blade channel flow field of the cooling fan.

The hereinafter-described embodiments of the disclosure are presented herein by way of exemplification and not limitation, with reference to the figures.

Referring to FIG. 1, a cooling fan 100 is provided by an embodiment of the disclosure, the cooling fan 100 includes a rotor hub 10 and a plurality of blades 20 mounted on periphery of the rotor hub 10. The blades 20 are mounted on the rotor hub 10 in unequal intervals, therefore the air-impelling force generated by each blade 20 is different, and the noise generated during operation of the fan is reduced.

In further embodiments, the rotor hub 10 and the blades 20 thereon are integrally-formed.

The rotor hub 10 is connected to an external driving device. The external driving device in this embodiment is a motor. It should be understood that, in further embodiments, the rotor hub 10 can be formed in any revolved body shape, such as a cup-shaped structure or a cone-shaped structure.

The rotor hub 10 has a central axis $L_0$, in further embodiments, the rotor hub 10 is configured with a plurality of ventilation holes (not shown) evenly distributed around the central axis, for enhancing the cooling effect of the cooling fan 100.

In further embodiments, the rotor hub 10 is configured with a plurality of reinforcing ribs (not shown) for enhancing structural stability of the rotor, which reduces vibration of cooling fan 100 during rotation.

The cooling fan 100 according to this embodiment is configured with 5 blades. In further embodiments, the number of the blades 20 is preferably 3-8. Most preferably, the number of the blades 20 is any odd number from 3-8, an odd number of blades improves stability of the cooling fan 100 and reduces noises during operation.

Each blade 20 comprises a first surface 21 and a second surface 22 relative to the first surface 21, the first surface 21 comprises a first side 211, a second side 212, a third side 213, and a fourth side 214, wherein the blade 20 is connected to the rotor hub 10 at the third side 213 and the fourth side 214 is opposite to the third side 213 and away from the rotor hub 10, the first side 211 and the second side 212 extend from the rotor hub 10 and are connected between the third side 213 and the fourth side 214.

The first side 211 and the second side 212 are connected to the rotor 10 at a first intersection $M_1$ and a second intersection $M_2$, respectively; the connection between the first side 211 and the fourth side 214 and the connection between the second side 212 and the fourth side 214 are both curved, such curving reduces resistance of the air acting on the blades 20, therefore the air flow produced by the cooling fan 100 is more forceful and the cooling effect of the cooling fan 100 is greater. In addition, the curving connections make processing of blades 20 easier.

Figure 2:
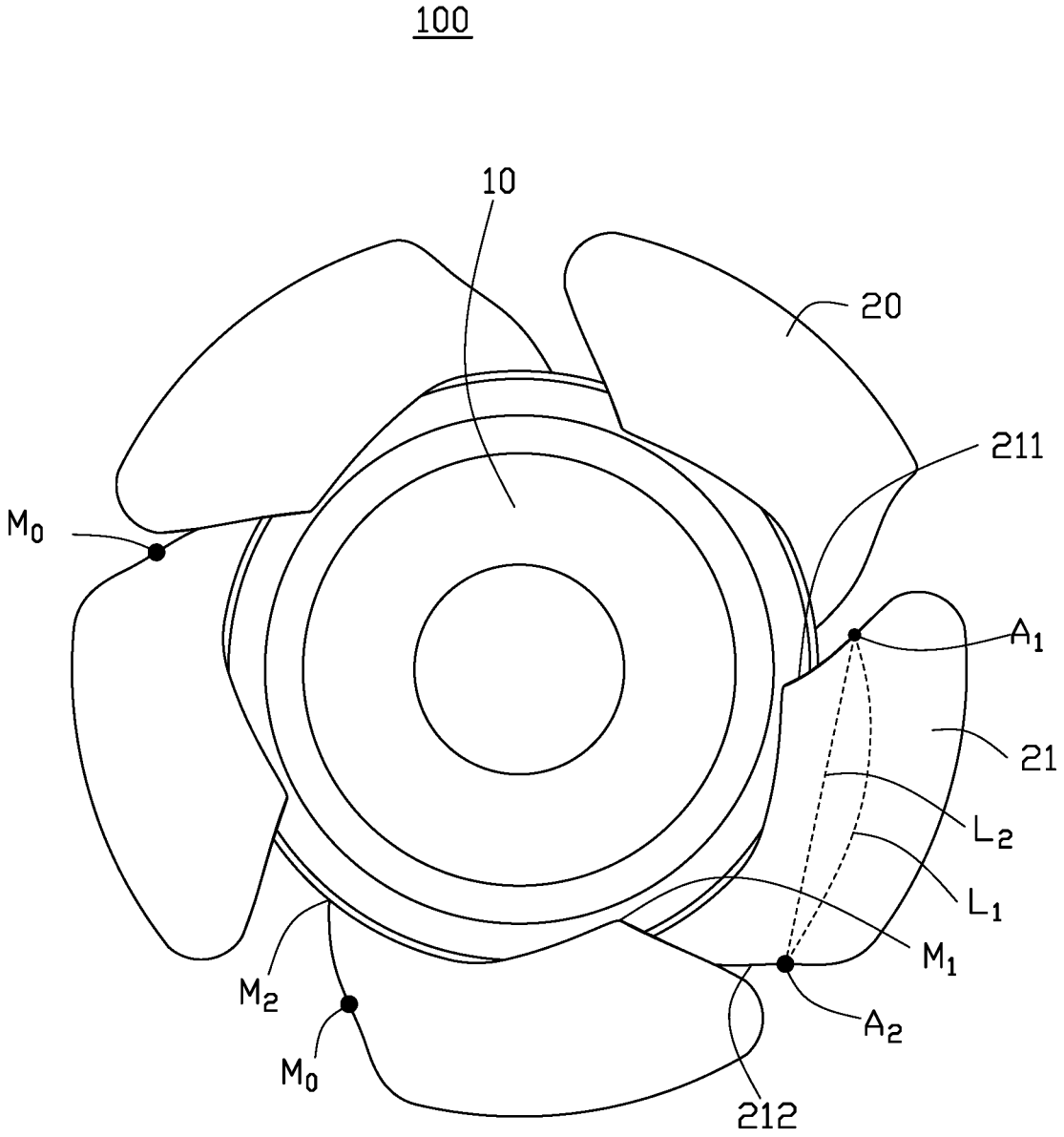
FIG. 2 is a top view of the cooling fan in FIG. 1.
Figure 3:
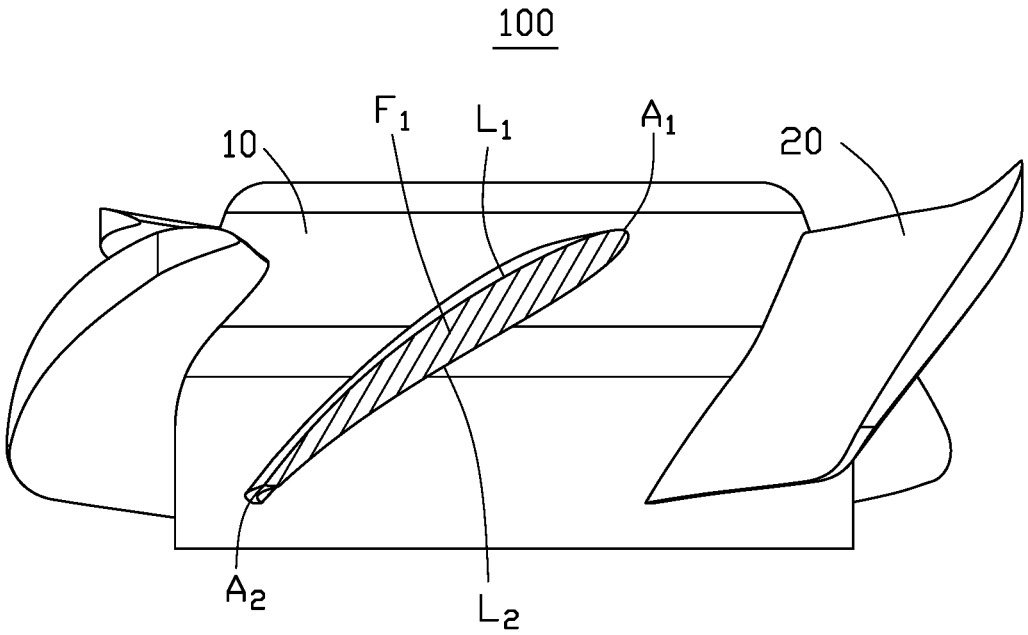
FIG. 3 is a side view of cooling fan in FIG. 1.

Referring to FIGS. 2-3, the blade 20 is provided with a first projection plane $F_1$, which is parallel to a tangential plane of the rotor hub 10. The first projection plane $F_1$ intersects with the first surface 21 at a first line $L_1$ and intersects with the second surface 22 at a second line $L_2$, the first line $L_1$ and the second line $L_2$ are connected by a first point $A_1$ on the first side 211 and a second point $A_2$ on the second side 212. Therefore the blade 20 has a profile on the first projection plane $F_1$ formed by the first line $L_1$, the second line $L_2$, the first point $A_1$, and the second point $A_2$.

Figure 4:
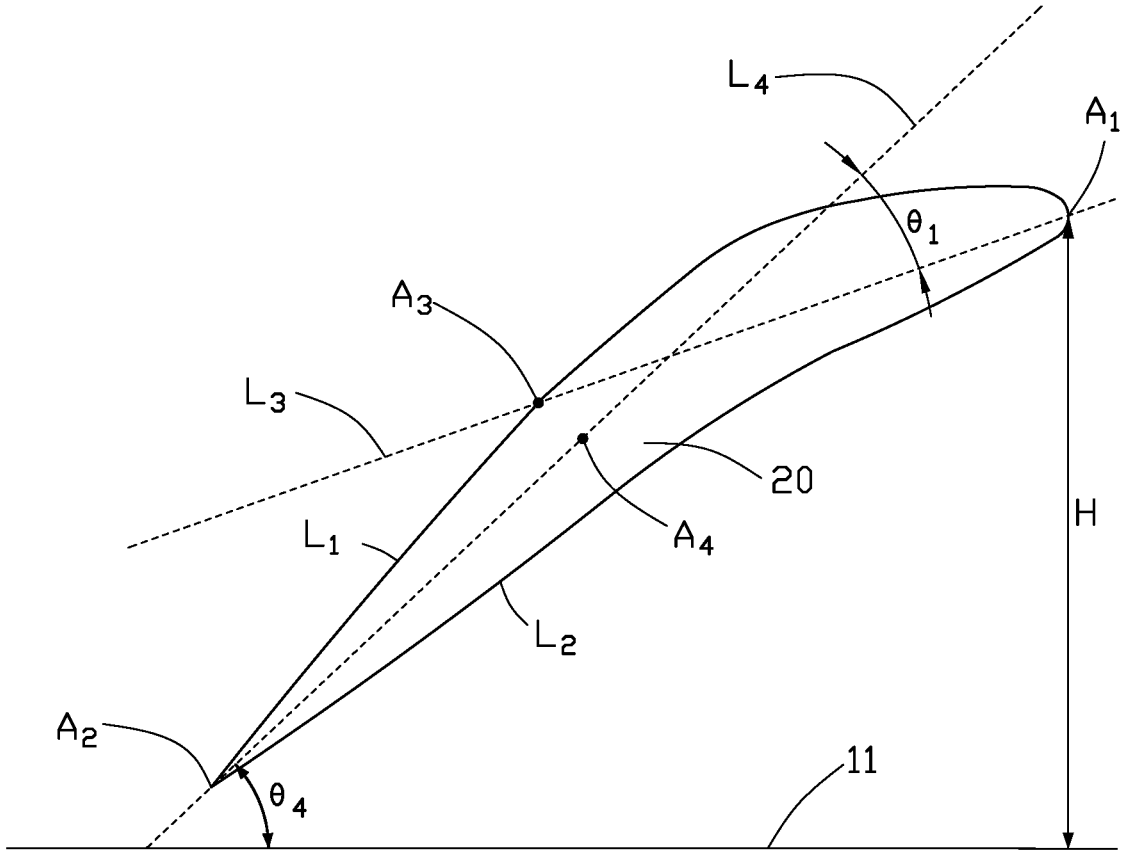
FIG. 4 shows a profile of a fan blade on a first projection plane.

The first surface 21 is an irregular convex surface with a vertex (not shown) and the second surface 22 is an irregular concave surface with a depression point (not shown). As shown in FIG. 4, the vertex is projected on $F_1$ to form a third point $A_3$ and the depression point is projected on $F_2$ to form a fourth point $A_4$. An angle between a third line $L_3$ connecting $A_1$ and $A_3$ and a fourth line $L_4$ connecting $A_2$ and $A_4$ is defined as a first angle $\theta_1$. The first angles $\theta_1$ of adjacent blades 20 are different. In this embodiment, such configuration allows adjacent blades 20 to have different inlet angles and outlet angles, which improves airflow velocity for each blade 20 and cooling effect of the cooling fan 100, counteracting any impairment in the cooling effect from the unequal distribution of the blades 20. Preferably, the angle difference between the first angle $\theta_1$ of adjacent blades 20 ranges from 1° to 4°.

Figure 5:
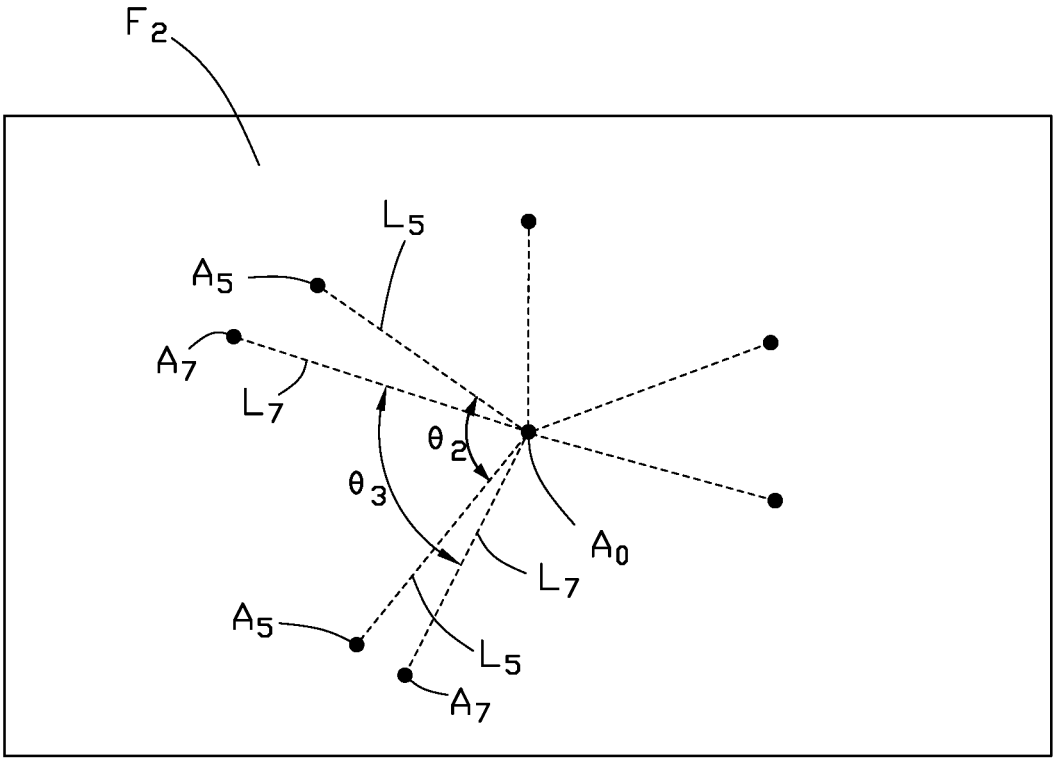
FIG. 5 shows points of the fan blade projected on a second projection plane.

Referring to FIG. 1 and FIG. 5, the rotor hub 10 comprises a base 11, and a second projection plane $F_2$ is provided parallel to the base 11. A center point of the base 11 is projected on the second projection plane $F_2$ to from a reference point $A_0$, the second intersection $M_2$ of each blade 20 is projected on the second projection plane $F_2$ to form a fifth point $A_5$. A fifth line $L_5$ is formed by connecting the fifth point $A_5$ with the reference point $A_0$. The angle between the fifth line $L_5$ of adjacent blades 20 is defined as a second angle $\theta_2$, the second angles $\theta_2$ of adjacent blades are different. In this embodiment, angle difference between the second angle $\theta_2$ of adjacent blades 20 ranges from 2° to 15°. The noise generated by unequally-distributed blades 20 is generally same as that of equally distributed blades 20 when the angle difference between the second angle $\theta_2$ of adjacent blades is smaller than 2°, and the noise generated by unequally distributed blades 20 is reduced as the angle difference increases from 2° to 15°. After 15°, the improvement of noise reduction is no longer significant and the fan 100 tends to yaw during operation.

In further embodiments, referring to FIG. 2 and FIG. 5, for each blade 20, a second reference point $M_0$ is picked on the second side 212, wherein the second reference point $M_0$ is provided with a certain distance from the second intersection $M_2$. The second reference point $M_0$ of each blade 20 is projected on the second projection plane $F_2$ to form a seventh point $A_7$. A seventh line $L_7$ is formed by connecting $A_7$ with the reference point $A_0$. The angle between the seventh line $L_7$ of adjacent blades 20 is defined as a third angle $\theta_3$, the third angles $\theta_3$ of adjacent blades are different from the respective second angles $\theta_2$, such that the noises generated by the unequally-distributed blades 20 are reduced.

Referring to FIG. 4, the angle between the fourth line $L_4$ and the base 11 is defined as a fourth angle $\theta_4$, the fourth angles $\theta_4$ of adjacent blades are different for varying the air flow channel for each blade 20, therefore any instability of blade channel flow field caused by the unequally distributed blades 20 is reduced and the noise of the cooling fan 100 is reduced without affecting the cooling effect. In this embodiment, the angle difference between the fourth angle $\theta_4$ of adjacent blades 20 ranges from 0° to 3°.

The distance from the first point $A_1$ of each blade 20 to the base 11 is defined as height H, the height H of adjacent blades varies and the difference between height H of adjacent blades 20 ranges from 0 mm to 3 mm. The air flow channel can be regulated by setting different heights H for each blade 20 to improve the stability of the blade channel flow field of the fan 100, which reduces the noise generated during operation of the cooling fan 100 without affecting the cooling effect.

Figure 6:
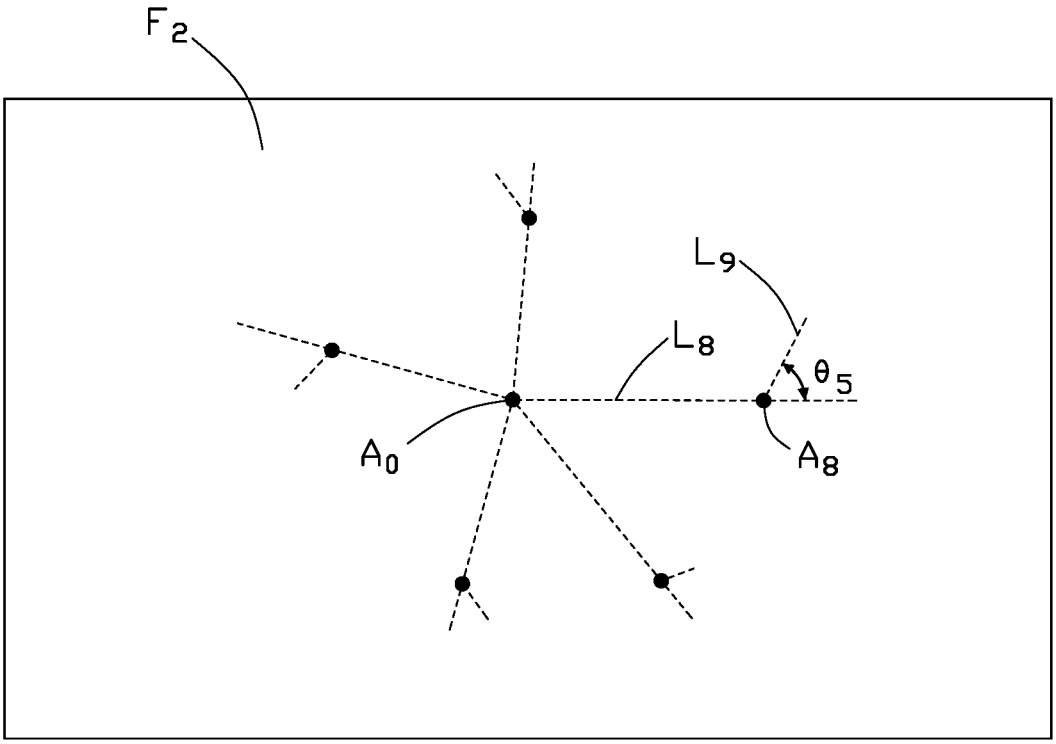
FIG. 6 shows other points of the fan blade projected on a second projection plane.

In further embodiments, referring to FIG. 1 and FIG. 6, for each blade 20, the first intersection $M_1$ is projected on the second projection plane $F_2$ to form an eighth point $A_8$. An eighth line $L_8$ is formed by connecting the eighth point Ag with the reference point $A_0$, and a ninth line $L_9$ is formed by projecting the first line 211 on the second projection plane $F_2$. The angle between the eighth line $L_8$ and the ninth line $L_9$ is defined as a fifth angle $\theta_5$, the fifth angles $\theta_5$ of adjacent blades are different such that the adjacent blades have different inlet and outlet angles, therefore the airflow velocity is improved for the fan 100, the noise generated during operation of the cooling fan 100 is reduced without affecting the cooling effect. Preferably, the angle difference between the fifth angles $\theta_5$ of adjacent blades 20 ranges from 0.5° to 5°.

In further embodiment, the first side 211 is curved and is projected on the second projection plane $F_2$ to form a projection line, the projection line has a tangent line $L_{10}$ passing the eighth point Ag, the angle between the tangent line $L_{10}$ and the third line L3 is defined as a fifth angle $\theta_5$ for each blade 20.

In operation, the cooling fan 100 according to the application is connected to the external driving device via the rotor hub 10. The blades 20 rotate with the rotor hub 10 to generate airflow, as the second angles $\theta_2$ of adjacent blades 20 are different, the blades 20 are unequally distributed on the rotor hub 10, and such configuration allows each blade 20 to impel air non-periodically, which avoid the impelling being superimposed and reduces the noises generated by the cooling fan 100. In addition, the fifth angles $\theta_1$ and fifth angles $\theta_5$ of adjacent blades 20 are different such that the inlet angles and outlet angles are different, which improves the airflow velocity of the cooling fan 100. Further, as the fourth angles $\theta_4$ and the height H of adjacent blades 20 are different, the airflow channel of each blade is varied for improving stability of the flow field of the fan 100, which reduces the noise generated during operation of the cooling fan 100 without affecting the cooling effect.

The cooling fan 100 according to the application is configured with unevenly spaced blades 20 on the rotor 10, which avoids periodic forcing and impelling of air, adjacent blades 20 have different inlet and outlet angles due to their different configurations, which improves the airflow velocity and stability of the blade channel flow field of the cooling fan 100.

While the invention has been described in detail in connection with only a limited number of embodiments, it should be readily understood for the skilled in the art that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A cooling fan comprising:

a rotor hub; and a plurality of blades mounted on a periphery of the rotor hub in unequal intervals, wherein each of the plurality of blades comprises a first surface and a second surface opposite to the first surface, the first surface comprises a first side, a second side, a third side, and a fourth side, wherein each of the plurality of blades is connected to the rotor hub at the third side and the fourth side is opposite to the third side and away from the rotor hub, the first side and the second side extend from the rotor hub and are connected between the third side and the fourth side, wherein each of the plurality of blades is provided with a first projection plane parallel to a tangential plane of the rotor hub, the first projection plane intersects with the first surface at a first line and intersects with the second surface at a second line, the first line and the second line are connected by a first point on the first side and a second point on the second side, a profile of each of the plurality of blades being defined on the first projection plane formed by the first line, the second line, the first point, and the second point, and wherein the first surface of each of the plurality of blades is an irregular convex surface with a vertex and the second surface of each of the plurality of blades is an irregular concave surface with a depression point, the vertex is projected on the first projection plane to form a third point and the depression point is projected on the first projection plane to form a fourth point, an angle between a third line connecting the first point and the third point and a fourth line connecting the second point and the fourth point is defined as a first angle, the first angles of each two adjacent blades are different.

2. The cooling fan of claim 1, wherein the second side of each of the plurality of blades is connected to the rotor hub at a second intersection;

the rotor hub comprises a base, and a second projection plane is provided parallel to the base, a center point of the base is projected on the second projection plane to form a reference point, the second intersection of each of the plurality of blades is projected on the second projection plane to form a fifth point, a fifth line is formed by connecting the fifth point with the reference point; the angle between the fifth line of two adjacent blades is defined as a second angle, the second angle of each two adjacent blades are different.

3. The cooling fan of claim 2, wherein an angle difference between the second angle of each two adjacent blades ranges from 2° to 15°.

4. The cooling fan of claim 2, wherein the angle between the fourth line of each of the plurality of blades and the base is defined as a fourth angle, an angle difference between the fourth angle of each two adjacent blades ranges from 0° to 3°.

5. The cooling fan of claim 2, wherein a distance from the first point of each of the plurality of blades to the base is defined as height, a difference in the height between each two adjacent blades ranges from 0 mm to 3 mm.

6. The cooling fan of claim 2, wherein the first side of each of the plurality of blades is connected to the rotor hub at a first intersection;

the first intersection is projected on the second projection plane to form an eighth point, an eighth line is formed by connecting the eighth point with the reference point, a ninth line is formed by projecting the first line of a respective blade on the second projection plane, an angle between the eighth line and the ninth line is defined as a fifth angle, an angle difference between the fifth angles of each two adjacent blades ranges from 0.5° to 5°.

7. The cooling fan of claim 1, wherein a difference between angles between the first angle of each two adjacent blades ranges from 1° to 4°.

8. The cooling fan of claim 1, wherein a filleted corner is arranged at the connection of the first side and the fourth side of each of the plurality of blades and the connection of the second side and the fourth side of each of the plurality of blades is filleted corner.

9. The cooling fan of claim 1, wherein the cooling fan is provided with 3-8 blades.

10. The cooling fan of claim 1, wherein the rotor hub and the plurality of blades thereon are integrally formed.

* * * * *